US007628634B2

(12) United States Patent
Yeh et al.

(10) Patent No.: US 7,628,634 B2
(45) Date of Patent: Dec. 8, 2009

(54) ELECTRICAL CONNECTOR WITH IMPROVED PACKAGE RETENTION DEVICE

(75) Inventors: Cheng-Chi Yeh, Tu-cheng (TW); Nan-Hung Lin, Tu-cheng (TW); Hao-Yun Ma, Chandler, AZ (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/322,114

(22) Filed: Jan. 29, 2009

(65) Prior Publication Data

US 2009/0191744 A1 Jul. 30, 2009

(30) Foreign Application Priority Data

Jan. 28, 2008 (TW) ..... 97201807 U
May 26, 2008 (TW) ..... 97209120 U

(51) Int. Cl.
*H01R 13/62* (2006.01)

(52) U.S. Cl. ..... 439/331

(58) Field of Classification Search ..... 439/73, 439/330, 331, 564, 573
See application file for complete search history.

(56) References Cited

U.S. PATENT DOCUMENTS 6,890,203 B2 * 5/2005 Matsunaga et al. ..... 439/331
7,234,955 B1 * 6/2007 Ho ..... 439/331
D596,124 S * 7/2009 Ma et al. ..... D13/133
2008/0124955 A1 5/2008 Szu

FOREIGN PATENT DOCUMENTS

TW M282369 6/2005

* cited by examiner

*Primary Examiner*—Khiem Nguyen
(74) *Attorney, Agent, or Firm*—Andrew C. Cheng; Wei Te Chung; Ming Chieh Chang

(57) ABSTRACT

An electrical connector includes a socket body with a number of contacts, a retention frame spaced from the socket body, a load plate attached to the retention frame, and a fastener. The retention frame located at a first side of the socket body and the load plate attached to at a second side of the socket body. The load plate rotates toward or away from the socket body from an open position to a closed position. The fastener is used to fasten the load plate at the closed position.

3 Claims, 10 Drawing Sheets

ELECTRICAL CONNECTOR WITH IMPROVED PACKAGE RETENTION DEVICE

1. FIELD OF THE INVENTION

The present invention relates to an electrical connector, and more particularly to an electrical connector which is mounted on a printed circuit board (PCB) for receiving an IC package, and which has an improved retention device for securing the package.

2. DESCRIPTION OF THE PRIOR ART

Central Processing Unit (CPU) and other electrical package, generally referred to as IC package, commonly works via an electrical connector mounted on a printed circuit board, which includes at least a socket with a number of contacts for electrical connection with the IC package and securing means for fastening the IC package.

U.S. Pat. No. 7,278,860 issued to Hao-Yun Ma on Oct. 9, 2007 discloseds such an electrical connector, which is soldered on a printed circuit board to receive an IC package. Referring to FIG. 1 and FIG. 4 of this patent, the electrical connector includes an insulative housing with a number of contacts received therein, a metallic stiffener located around the housing, a load plate for pressing an IC package that seated on the housing, and a load lever for fastening the load plate. What is disadvantageous in U.S. Pat. No. 7,278,860 is the metallic stiffener occupies a large periphery area around the housing, therefore it is not helpful to save space on the printed circuit board. Further, the electrical connector employs a stiffener which needs a large amount of metal material, and is also not economic.

TW Patent No. M282369 issued to Molex on Jun. 21, 2005 discloseds another CPU socket, which includes an insulative housing, a metal stiffener located around the housing, a top load plate rotatable relative to the stiffener, and a screw for securing the load plate on the stiffener. The load plate has a through hole for the screw extending therethrough and engaging with a screw hole defined on the stiffener. Therefore, the CPU socket can keep a package thereon reliably. This socket needs employ a stiffener for securing the package. It is not only complicates the structure of the socket but also need much more materials for the stiffener.

Thus, there is a need to provide a new electrical connector that overcomes the above-mentioned problems.

SUMMARY OF THE INVENTION

An object of the present invention is to provide an electrical connector not only simplifying the structure but also reducing the cost.

In order to achieve the object set forth, an electrical connector made in accordance with the present invention includes a socket body with a plurality of contacts received therein, a retention frame located at a first side of the socket body and spaced from the socket body, a load plate attached to the retention frame at a second side of the socket body. The load plate is capable of rotating toward or away from the socket from an open position to a closed position. A fastener is secured on the load plate to fasten the load plate at the closed position.

BRIEF DESCRIPTION OF THE DRAWINGS

Other objects, advantages and novel features of the present invention will become more apparent from the following detailed description when taken in conjunction with the accompanying drawings, in which.

DETAILED DESCRIPTION OF PREFERRED EMBODIMENT

Figure 1:
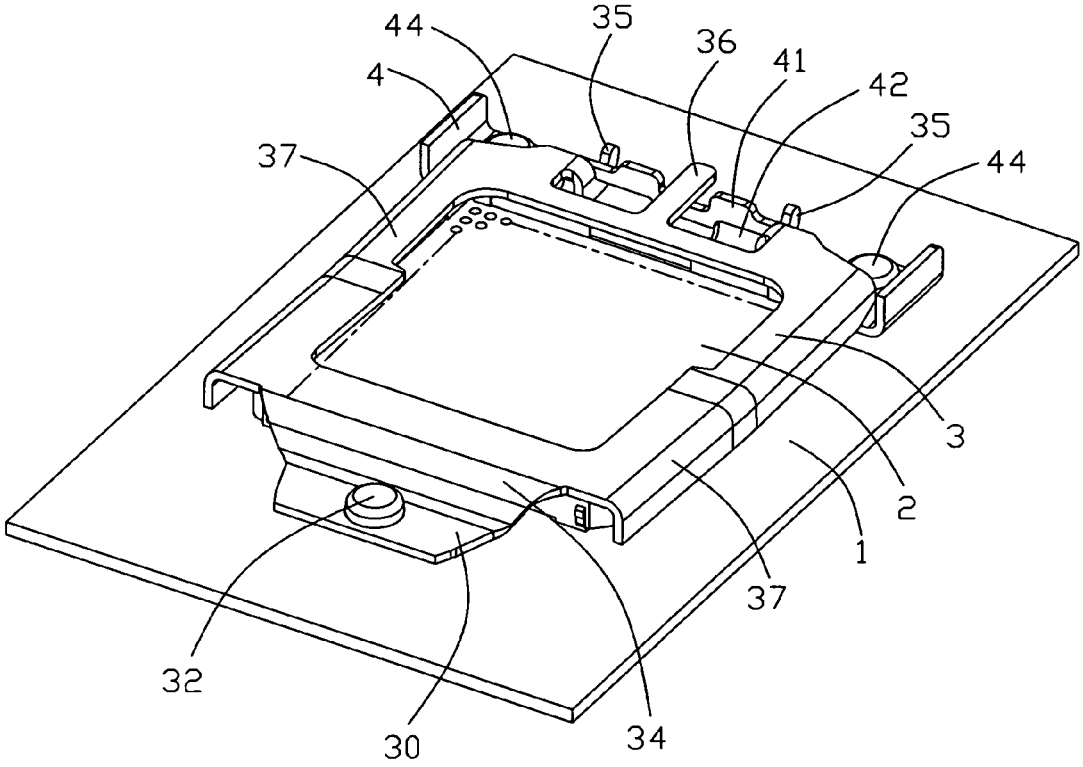
FIG. 1 is an assembled, perspective view of an electrical connector in accordance with a preferred embodiment of the present invention, in which a load plate is in a closed position.
Figure 2:
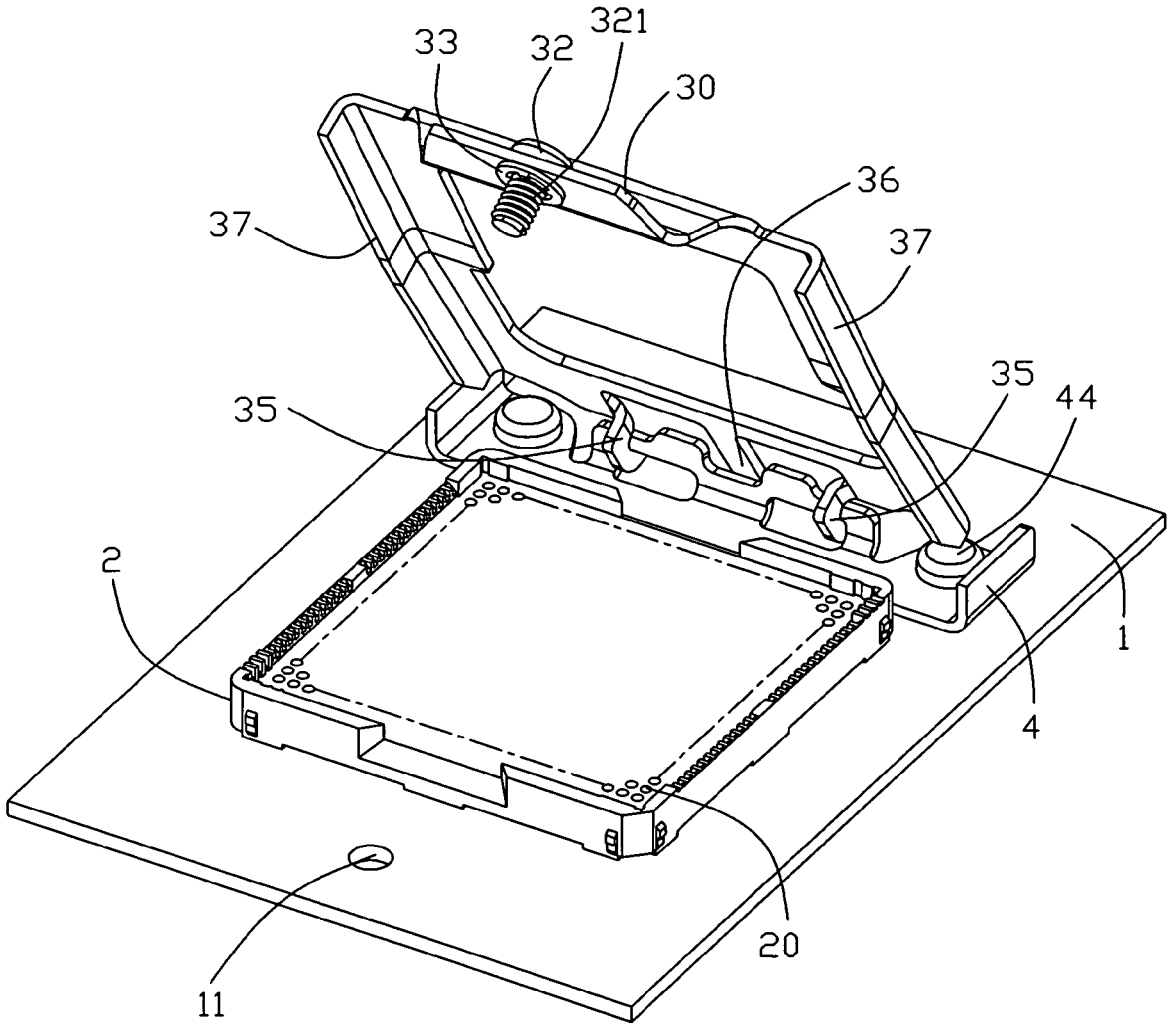
FIG. 2 is an assembled, perspective view of the electrical connector shown in FIG. 1, in which the load plate is in an open position.
Figure 3:
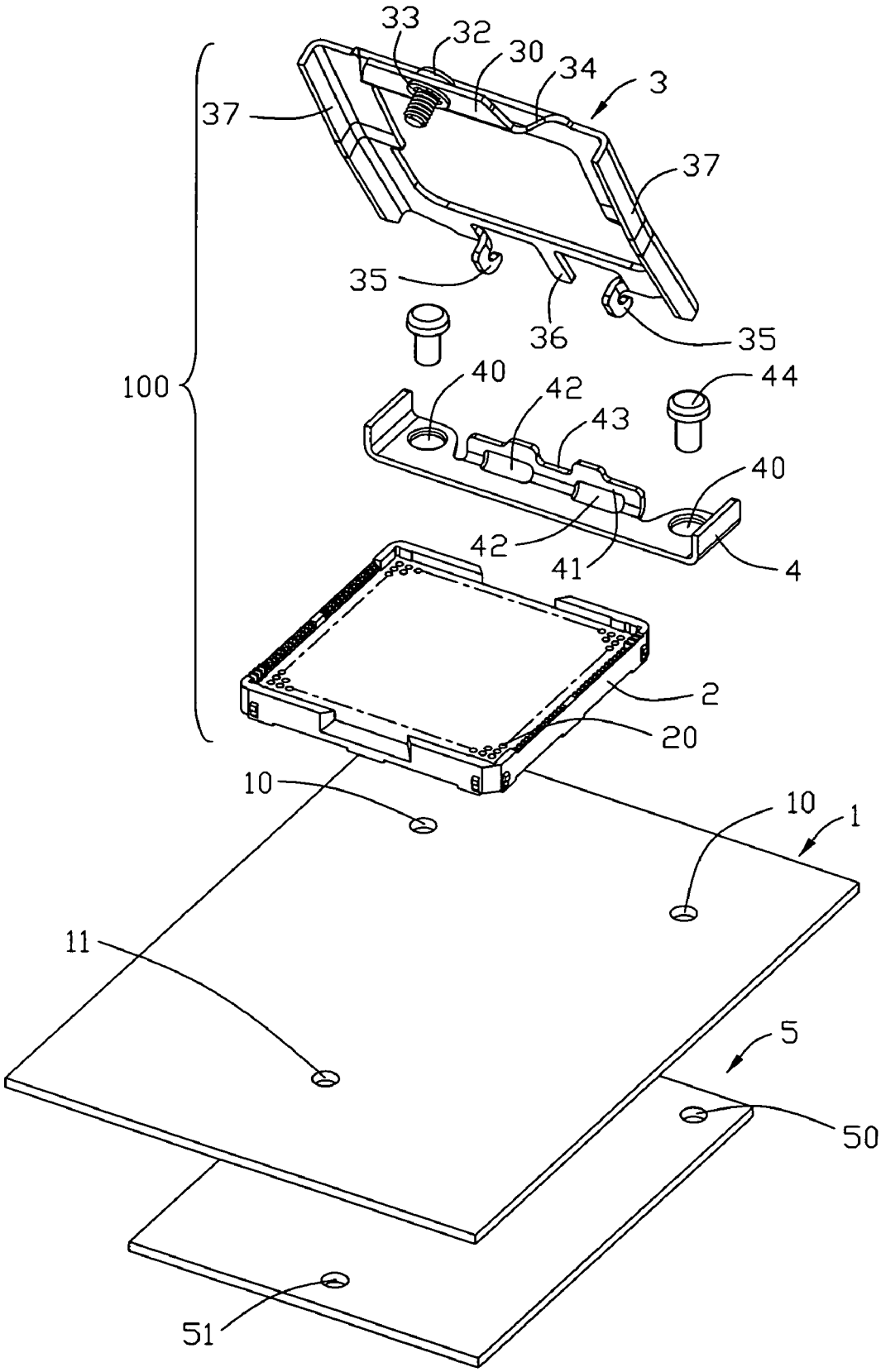
FIG. 3 is an exploded, perspective view of the electrical connector shown in FIG. 1.
Figure 5:
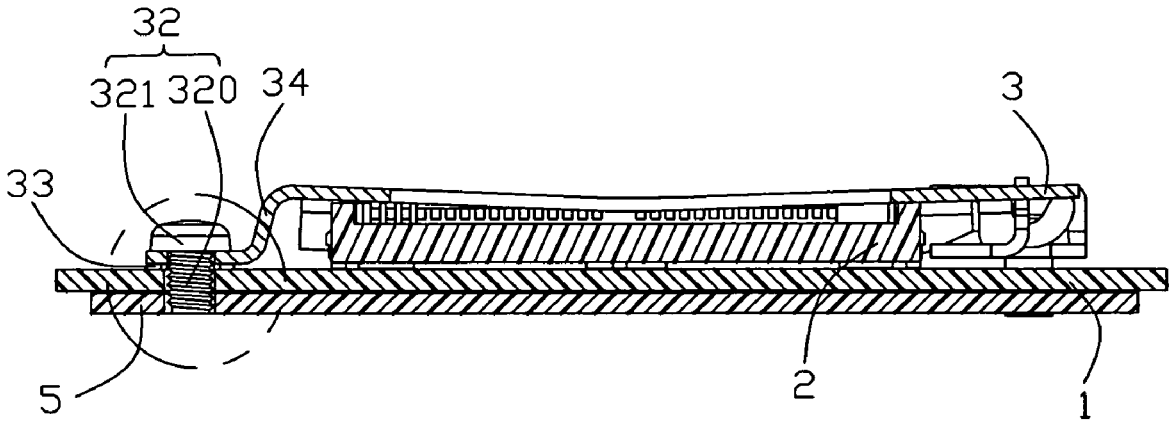
FIG. 5 is a sectional view of the electrical connector shown in FIG. 1.

Referring to FIGS. 1 and 5, an electrical connector 100 in accordance with a preferred embodiment of the present invention is generally mounted to a printed circuit board 1 to receive an IC package (not shown). The electrical connector 100 includes a socket body 2 with a plurality of electrical contacts (not shown) secured thereon, a metal load plate 3 covering the socket body 2, a retention frame 4 for securing the load plate 3 on the printed circuit board 1, and a back plate 5. A fastener such as a first bolt 32 is provided to engage with the load plate 3 and fasten the load plate 3 on the printed circuit board 1.

The IC package is seated to the socket body 2 to make electrical connection with the contacts. The load plate 3 is connected with and supported by the retention frame 4. The socket body 2 defines a plurality of passages 20 extending therethrough for receiving the contacts. The socket body 2, load plate 3, and retention frame 4 are located on a top side of the printed circuit board 1.

Please referring to FIG. 1 to 4, the printed circuit board 1 has a first hole 11 at a first end and a pair of second holes 10 at a second end. The back plate 5 is located at a bottom side of the printed circuit board 1 and provided with a first screw hole (the thread thereof is not shown) 51 corresponding the first hole 11 and a pair of second through holes (the thread thereof is not shown) 50 corresponding to the second hole 10 of the printed circuit board 1.

The retention frame 4 is made by punching metal plate and located at one side of the socket body 2 on the printed circuit board 1. The retention frame 4 is arranged at one side of the socket body 2 and spaced from the socket body 2. The retention frame 4 is mounted to the second holes 50 by a pair of second bolts 44. The retention frame 4 has a base (not labeled) and a vertical plate 41 extending upwardly from the base. A pair of holes 40 are defined on the retention frame 4 for the second bolts 44 extending therethrough. The vertical plate 41 defines a pair of recesses 42 and a gap 43 located therebetween. Each second bolts 44 extends through the holes 40, 50 and engages with the screw hole 50 of the back plate 5.

The load plate 3 is hollow and defines an opening (not labeled). The load plate 3 includes a frame 37 and a tongue 30 at a first side of the frame 37. The tongue 30 has a first section 34 bending from the frame 37 and a second section (not labeled) extending outwardly from the first section 34. A hole 31 is defined on the second section of the tongue 30. The first bolt 32 extends through the holes 31, 51 and engages with the screw hole 51 of the back plate 5. The load plate 3 has a pair of hooks 35 bending downwardly for projecting into the recesses 42 for clasping the retention frame 4 at a second side thereof, and a press piece 36 between the hooks 35. The load plate 3 rotates towards or away from the socket body 2 from an open position to a closed position. When the load plate 3 is at the closed position, the tongue 30 contacts with a top face (not labeled) of the printed circuit board 1 and the press piece 36 is located in the gap 43 of the retention frame 4. The hooks 35 and the press piece 36 of the load plate 35 rotate around the retention frame 4 from the closed position to the open position.

Figure 4:
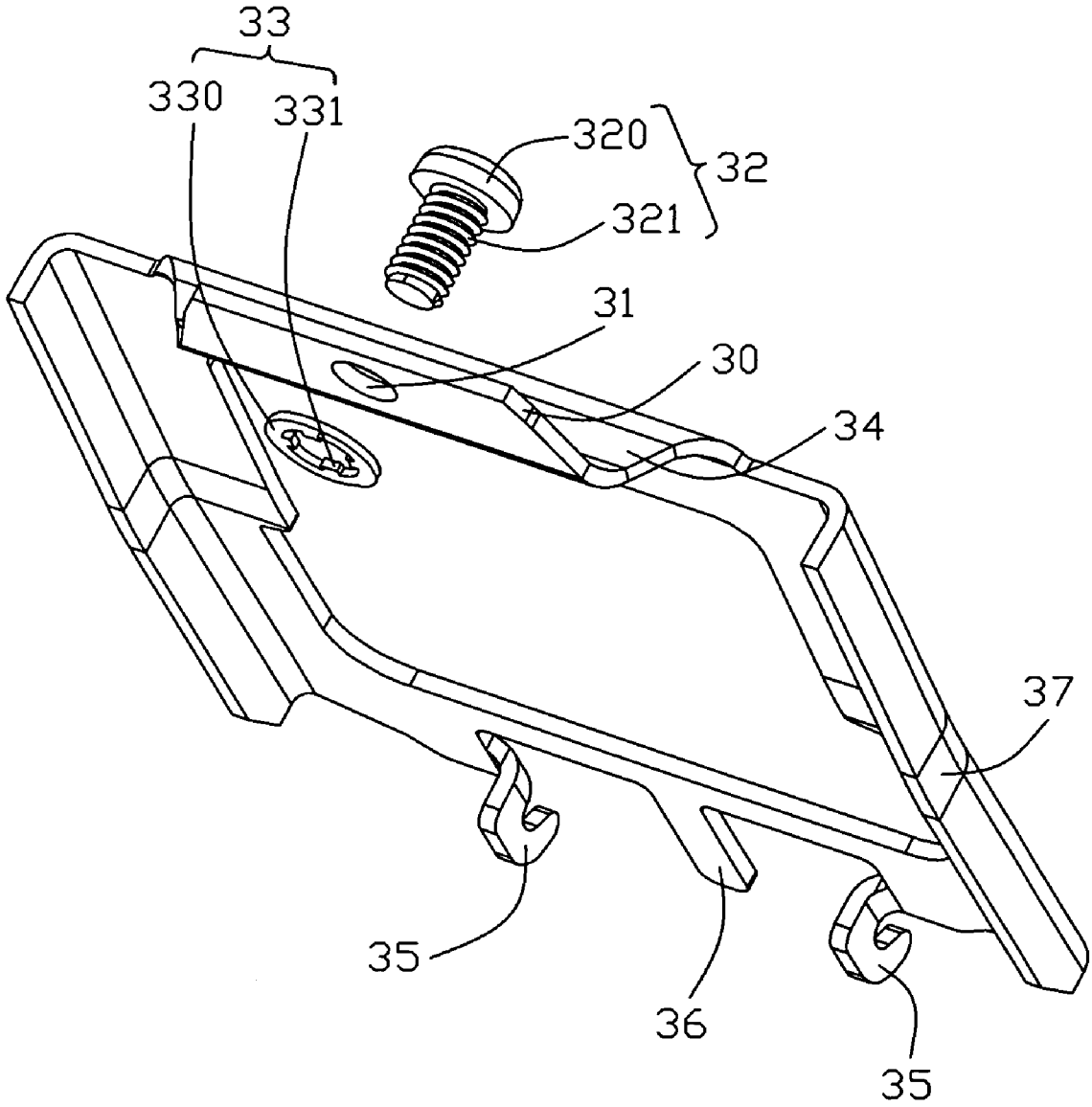
FIG. 4 is a perspective view of the load plate shown in FIG. 1.
Figure 6:
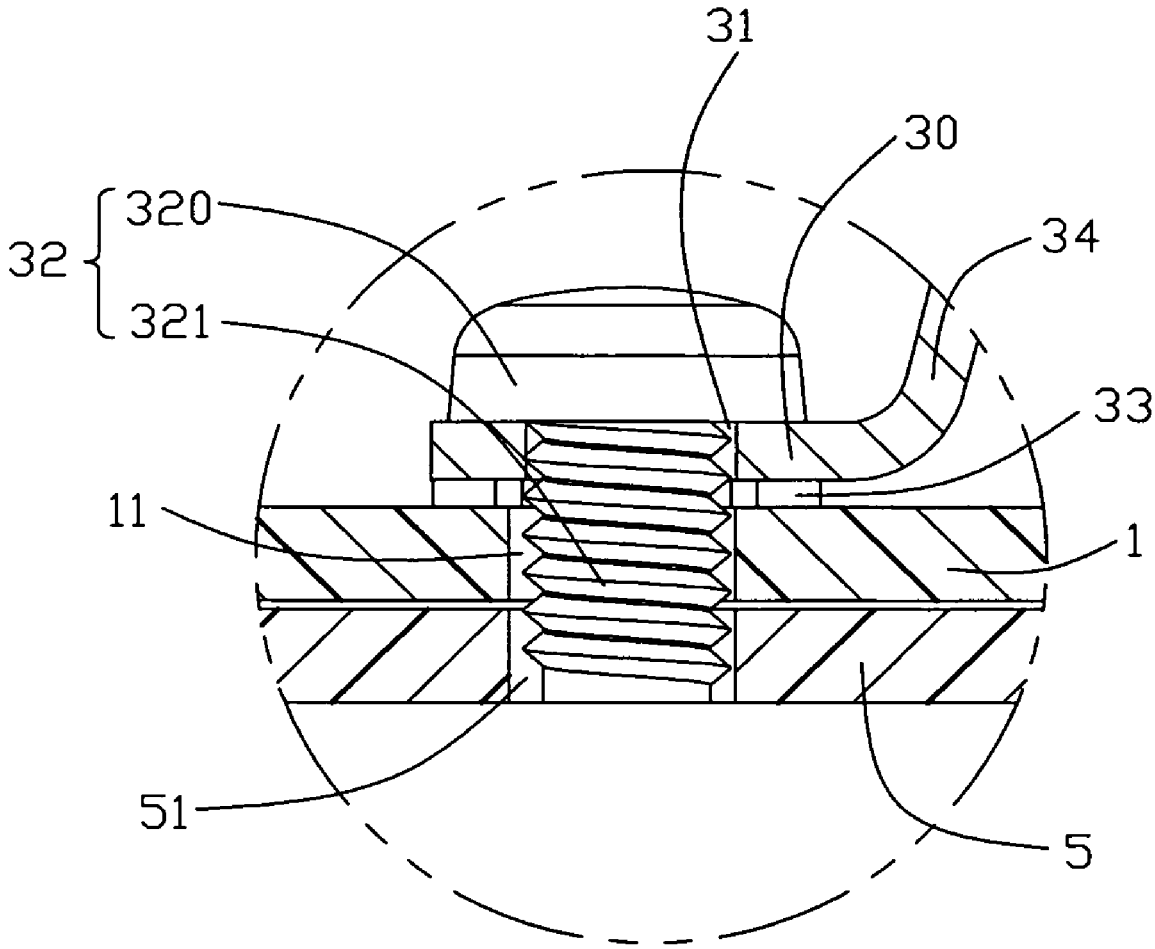
FIG. 6 is an enlarged view of a circle portion shown in FIG. 5.
Figure 7:
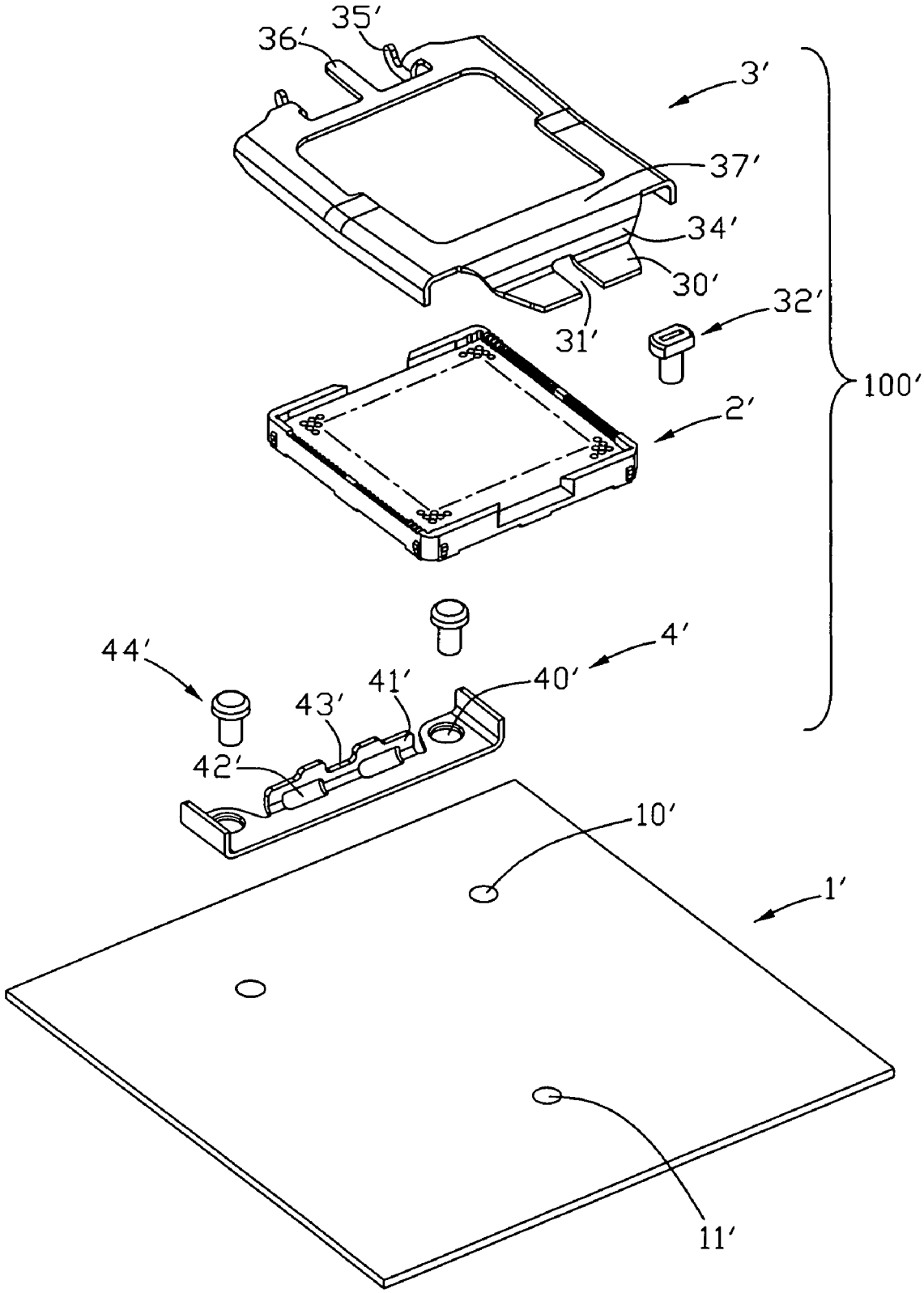
FIG. 7 is an exploded, perspective view of an electrical connector in accordance with a second embodiment of the present invention.
Figure 8:
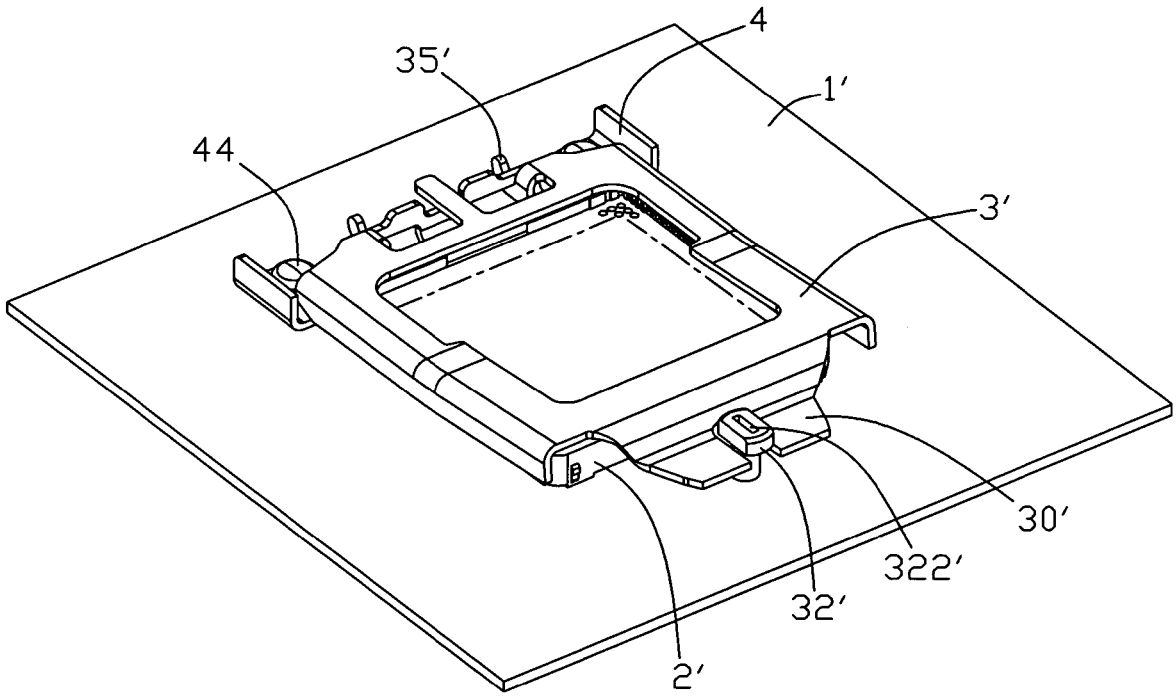
FIG. 8 is an assembled, perspective view of an electrical connector shown in FIG. 7, in which a screw is in an open position.
Figure 9:
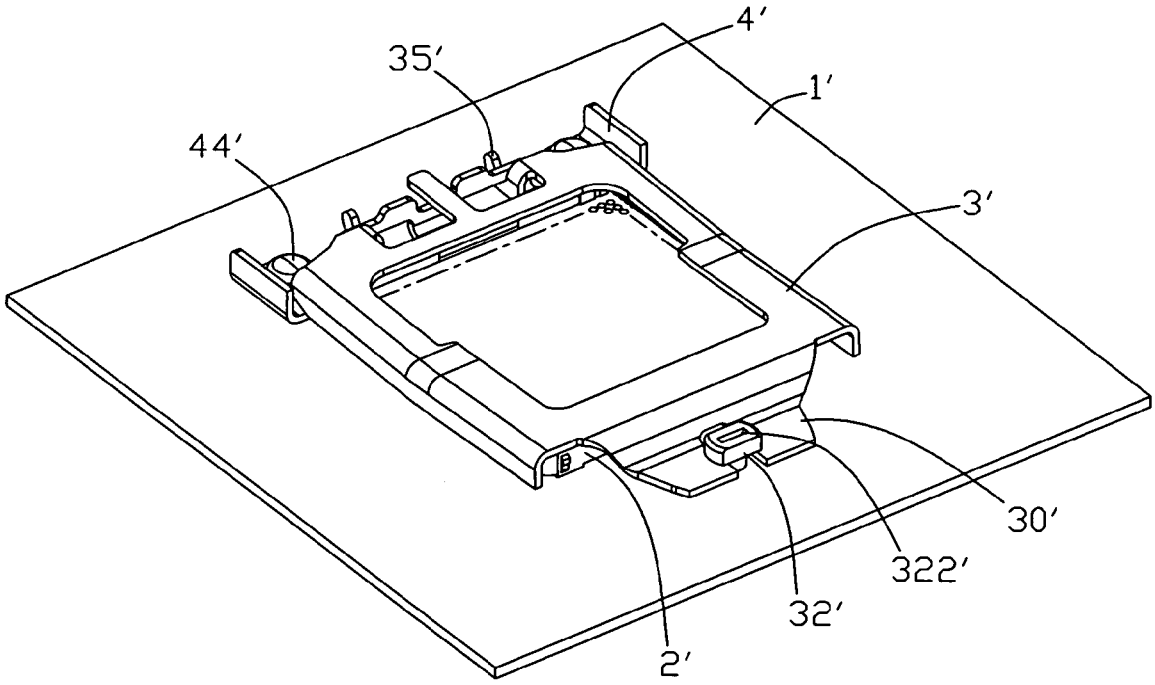
FIG. 9 is an assembled, perspective view of the electrical connector shown in FIG. 7, in which the screw is in a closed position.

Please referring to FIGS. 4 and 6, the first bolt 32 has a threaded rod 321 and a head 320 at one end thereof. A ring 33 includes an annual section 330 and a tooth section 331 engaging with the threaded rod 321 for retaining the first bolt 32 on the tongue 30.

The load plate 3 could be secured to the printed circuit board 1 by other fasteners. For example, the fastener needs not providing thread and engages with the second hole 51 directly, such as a board lock or the like. The back plate 5 also can be fasteners with threaded thereon and received in the first and second hole 51, 50 of the printed circuit board 1. The first and second bolt 32, 44 will engage with the fasteners directly. Moreover, the fasteners also can be mounted to the top face of the printed circuit board 1 for mating with the first and second bolts 32, 44.

FIGS. 7 to 10 show another electrical connector 100' according to a second embodiment of the present invention. The electrical connector 100' includes a socket body 2' with a plurality of electrical contacts (not shown) secured thereon, and a metal load plate 3' covering the socket body 2', a retention frame 4' for securing the load plate 3' on the printed circuit board 1'. A fastener such as a first bolt 32' is provided to engage with the load plate 3' to fasten the load plate 3' on the printed circuit board 1' at a closed position.

The load plate 3' and the socket body 2' is similar to the first embodiment. The load plate 3' is connected with and supported by the retention frame 4'. The socket body 2' defines a plurality of passages (not shown) extending therethrough for receiving the contacts. The socket body 2', load plate 3', and retention frame 4' are located on a top side of the printed circuit board 1'. Please referring to FIG. 7, the printed circuit board 1' has a first hole 11' at a first end and a pair of second holes 10' at a second end.

The retention frame 4' is made by punching metal plate and located at one side of the socket body 2' on the printed circuit board 1'. The retention frame 4' is arranged at one side of the socket body 2' and spaced from the socket body 2'. The retention frame 4' is mounted to the holes 10' by a pair of second bolts 44'. A pair of holes 40' are defined on the retention frame 4' for the second bolts 44' extending therethrough. The retention frame 4' has a base (not labeled) and a vertical plate 41' extending upwardly therefrom which defines a pair of recesses 42' and a gap 43' located therebetween. Each second bolts 44' extends through the holes 40', 10'.

The load plate 3' is hollow and defines an opening (not labeled). The load plate 3' includes a frame 37' and a tongue 30' at a first side of the frame 37'. The tongue 30' has a first section 34' bending from the frame 37' and a second section (not labeled) extending outwardly from the first section 34'. A hole 31' is defined on the second section of the tongue 30'. The first bolt 32' extends through the holes 31' and engages with the hole 11'. The load plate 3' has a pair of hooks 35' bending downwardly for projecting the recesses 42' and clasping the retention frame 4' at a second side thereof, and a press piece 36' between the hooks 35'.

The load plate 3' rotates towards or away from the socket 2' from an open position to a closed position. When the load plate 3' is at the closed position, the tongue 30' contacts with a top face (not labeled) of the printed circuit board 1' and the press piece 36' is locate in the gap 43' of the retention frame 4'. The hooks 35' and the press piece 36' of the load plate 3' rotate around the retention frame 4' from the closed position to the open position.

Figure 10:
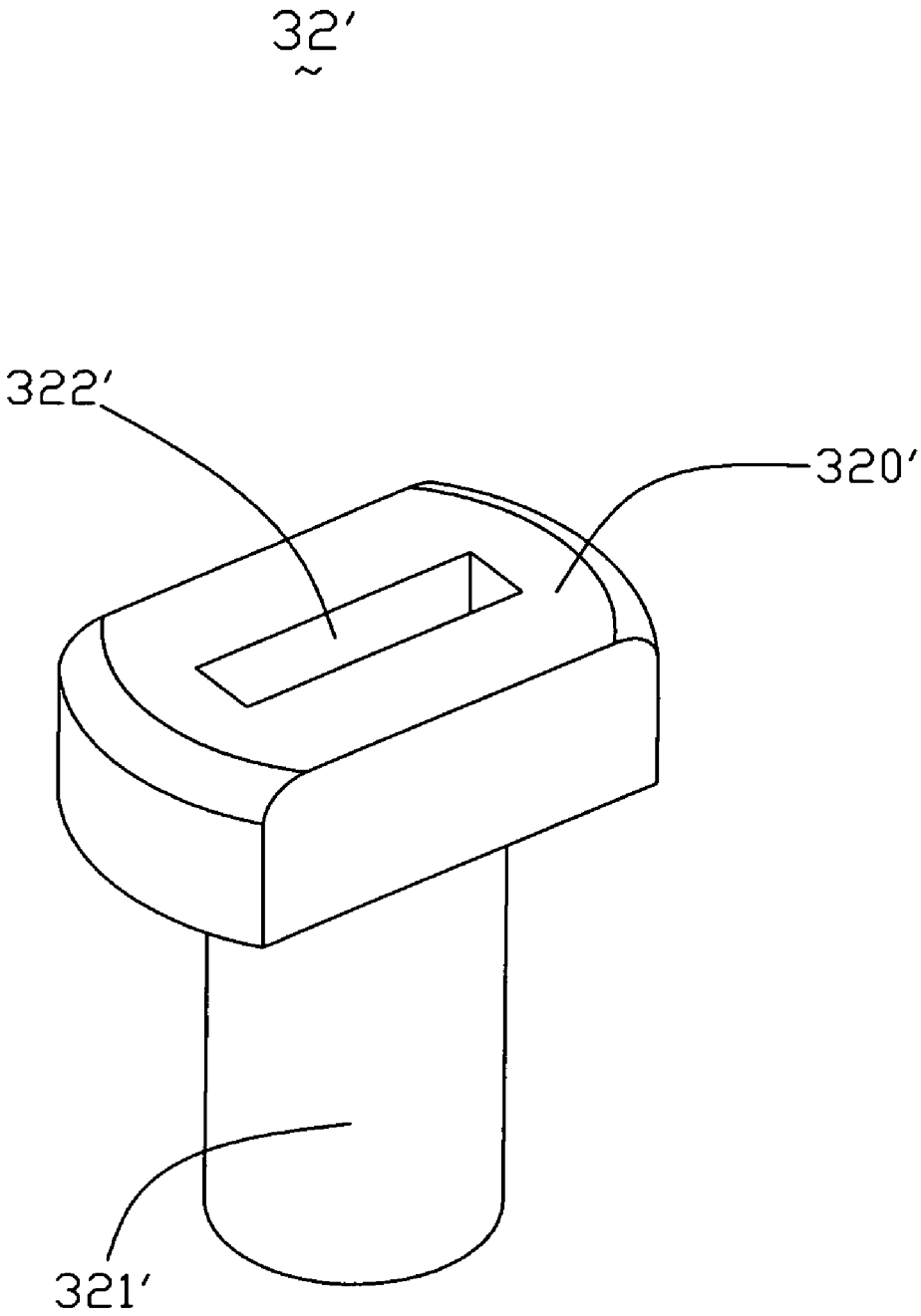
FIG. 10 is a perspective view of the screw shown in FIG. 7.

Please referring to FIG. 10, the first bolt 32' has a threaded rod 321' and a head 320' at one end thereof. The head 320' has a pair of round faces and a pair of flat faces so that a pair of sides of the head is longer than the other pair of sides. Therefore, the first bolt 32' can position the load plate 3' on the printed circuit board 1' after rotating a certain degree, which is preferred 90 degrees in the second embodiment.

Since the hole 31' is substantially equal to the head 320' of the first bolt 32', and opens to the first side of the load plate 3', the first bolt 32' could be mounted to the printed circuit board 1' firstly with the head 320' received in the hole 31'. In this time, the load plate 3' can rotate towards or away from the socket body 2'. For securing a package on the socket body 2', the load plate 3' is located at the closed position and covers the socket body 2'. The first bolt 32' can be rotated a certain degree to intersected with the hole 31' so that the head 320' presses the tongue 30' of the load plate 3'. The head 320' is further provided with a recess 322' for operating.

The first bolts 32, 32' is directly secured on the printed circuit board 1, 1' to fasten the load plate 3 at the closed position which simplify the assemble process of the electrical connector 100. The socket body 2, 2' occupies a first region of the printed circuit board, and the retention frame 4, 4' occupies a second region of the printed circuit board 1, 1'. The first and second region are arrange on the printed circuit board 1, 1' abreast. Since the retention frame 4, 4' is located only at one side of the socket body 2, 2', it doesn't need to provide another element on the other side of the socket body 2, 2' for securing the load plate 3, 3' or provide a stiffener as the prior art. For the stiffener of the prior art is substantially equal to the load plate, the retention frame 4, 4' of the present invention will save much material than the stiffener.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising: a socket body with a plurality of contacts received therein; a retention frame located at a first side of the socket body and spaced from the socket body; a load plate attached to the retention frame at the first side of the socket body, the load plate capable of rotating toward or away from the socket from an open position to a closed position; and a fastener located at a second side of the socket body and secured on the load plate to fasten the load plate at the closed position, wherein the load plate and the retention frame are made of metal plate, wherein the load plate covers the socket body and includes a frame and tongue bending downwardly and extending outwardly from the frame at one end of thereof, wherein the fastener extends through a hole on the tongue, and retained on the tongue by a ring, wherein the retention frame has base and a vertical plate extending upwardly the base, and the vertical plate defines a pair of holes thereon for respectively engaging with hooks formed on the other end of the load plate, wherein the retention frame defines a pair of holes on the base for receiving two second bolts, wherein the fastener is a bolt.

2. An electrical connector assembly for electrical connecting an IC package with a printed circuit board, comprising: a socket body with a plurality of electrical contacts secured thereon; a retention frame secured on the printed circuit board and separated from the socket body; a load plate pivotally mounted on the retention frame from an open position to a closed position; and a fastener securing the load plate to the printed circuit board at the closed position, wherein the socket body, retention frame and the load plate are located on a top side of the printed circuit board, further comprising a back plate located on a bottom side of the printed circuit board, and the fastener engaging with the back plate, wherein the socket body is arranged on a first region, and the retention frame is arranged on a second region of the printed circuit board; and wherein the first region and the second region are arranged on the printed circuit board side by side, wherein the fastener is a bolt, wherein the load plate has a frame and a tongue bending from the frame, and the tongue has a hole for receiving the fastener, wherein the hole of the tongue is substantially equal to the head of the bolt, and the load plate can be move relative to the socket body when the bolt is located in the hole, and the load plate is secured on the printed circuit board when the bolt rotates a certain degree.

3. An electrical connector assembly comprising: a printed circuit board; an insulative housing mounted upon the printed circuit board and defining opposite lengthwise first and second ends thereof; a plurality of contacts disposed in the housing; a metallic retention frame mounted upon the printed circuit board by the first end; a metallic load plate pivotally mounted upon the retention frame and defining a free end located around the second end when said load plate is in a horizontal closed position; and a rotatable fastener directly extending through the printed circuit board with an expanded head to downward pressing against a top face of the load plate; wherein said fastener is retrained from moving upward so as to assure the load plate is retained in said horizontal closed position, wherein said load plate defines a notch, and the expanded head of the fastener is only allowed to pass therethrough in a predetermined angled position via rotation for rotation of the load plate while locking the load plate when the expanded head is in other position, further including a back plate under the printed circuit board, where a bottom end of the fastener is secured.

* * * * *